United States Patent [19]

Flaherty

[11] Patent Number: 4,809,464

[45] Date of Patent: Mar. 7, 1989

[54] METHOD AND APPARATUS FOR SHARPENING METAL BLADES

[76] Inventor: Francis E. Flaherty, 12 Falmouth Landing Rd., East Falmouth, Mass. 02536

[21] Appl. No.: 172,433

[22] Filed: Mar. 24, 1988

[51] Int. Cl.[4] ..... B24B 3/52

[52] U.S. Cl. ..... 51/80 B; 51/80 BS

[58] Field of Search ..... 51/80 B, 80 BS, 81 BS, 51/82 BS, 80 R

[56] References Cited

U.S. PATENT DOCUMENTS

| | | | |
|---|---|---|---|
| 1,699,510 | 1/1929 | Gaisman et al. . | |
| 1,902,527 | 3/1933 | Schumacher . | |
| 2,281,975 | 5/1942 | Hill . | |
| 2,290,964 | 7/1942 | Hill | 51/80 B |
| 2,705,854 | 4/1955 | Laverdisse . | |
| 3,484,997 | 12/1969 | Allen | 51/80 R |
| 3,758,993 | 9/1973 | Kirtz | 51/80 BS |

*Primary Examiner*—James G. Smith

*Attorney, Agent, or Firm*—Norman B. Rainer

[57] ABSTRACT

Apparatus is provided for forming sharp edges on a flat metal blade strip. The apparatus is comprised of two series of synchronously rotated enmeshed abrasive wheels which successively contact the blade strip in opposite directions to remove the burr that ordinarily forms in the course of sharpening techniques.

7 Claims, 3 Drawing Sheets

METHOD AND APPARATUS FOR SHARPENING METAL BLADES

BACKGROUND OF THE INVENTION

This invention relates to the formation of sharp edges on blades by grinding or honing techniques, and more particularly concerns a method and apparatus for sharpening edges of substantially flat metal blades by advancing the blade in contact with rotating members.

In the production of razor blades, a continuous ribbon of flat metal stock, called a blade strip, is advanced in continuous contact with rapidly rotating abrasive wheels which sharpen one or both edges of the blade strip. The sharpening is achieved by removing metal in a continuous facet zone in each face of the blade strip adjacent an edge thereof. the facets are substantially equally but oppositely angled with respect to the face of the blade strip, and converge to an intersection which constitutes the cutting edge. A stropping operation generally follows the grinding step, its purpose being to remove any clinging fragments of metal and to generally smooth out any surface irregularities produced by the grinding step.

One method of making razor blades utilizes a series of disc-shaped grinding wheels stacked in parallel array with intervening spacers on two spindles whose axes of rotation closely parallel the direction of travel of the blade strip. The wheels of one array are intertwined or dovetailed with wheels of the other array in a manner whereby the spacer of one spindle is opposite a wheel of the other spindle. The blade strip travels along the nip or intersection of said interactive wheels in perpendicular disposition thereto, whereby the circular perimeters of the wheels of one array grind one facet, and the other array grind the opposite facet. The reason for the aforesaid arrangement of wheels is to overcome the phenomenon of burr formation, namely the buildup of metal on the side of the blade opposite the facet being ground. Another advantage of the opposing wheels is that support is provided for the blade strip which would otherwise bend away from the abrading wheel.

More recent methods of making razor blades, as disclosed in U.S. Pats. No. 2,281,975 and 2,290,964, replace the two opposed parallel arrays of wheels with two opposed identical wheels having a continuous spiral flute abrading surface disposed in a circular cylindric locus and bounded by a continuous spiral groove. The two wheels are disposed in a manner such that their cylindric axes are parallel, and the abrading flute of one wheel slightly penetrates into the groove of the opposing wheel. Such manner of wheel interengagement is preserved during rotation by gearing the wheel spindles so that they rotate synchronously in opposite directions.

The effect of the interengaged spiral wheels is to alternatively push the burr from side to side. The successive reversal of strain on the burr results in work hardening and ultimate fracture of the burr. Although more expensive, an advantage of the spiral wheel over the parallel array of spaced wheels is that the number of strain reversals on the burr is determined by the RPM of the spiral wheels. A further consequence of this effect is that the blade strip need not be advanced to be sharpened. However, for reasons of economics in the manufacture of razor blades, it is desirable to advance the blade strip at the highest possible speed.

In order to achieve proper sharpening, the blade strip, moving at high velocity past the grinding wheels, must experience an adequate number of strain reversals at the facets. Although faster rotation of spiral wheels can produce increased reversals, the spacing between adjacent turns of the abrasive flute is generally greater than the spacing achievable by the close stacking of flat grinding wheels. For example, in a spiral wheel of three inch cylindrical diameter, a spiral flute of one turn per axial inch would be the maximum practical pitch. By way of comparison, using flat wheels of ¼ inch thickness (or only a few thousandths smaller to allow clearance) two spaced pairs could be assembled within one inch of axial length, giving four strain reversals, which is twice greater than said spiral wheels, assuming one revolution per inch of blade travel.

It is accordingly an object of the present invention to provide a method for sharpening a blade strip at high linear velocity of said blade strip.

It is another object of the present invention to provide sharpening apparatus for causing a high number of burr reversals within a short distance of axial travel of said blade strip.

It is a further object of the present invention to provide grinding apparatus capable of sharpening flat metal blades without requiring linear motion of said blades past said grinding apparatus.

These objects and other objects and advantages of the invention will be apparent from the following description.

SUMMARY OF THE INVENTION

The above and other beneficial objects and advantages are accomplished in accordance with the present invention by an apparatus comprised of first and second series of abrasive wheels, each series having a substantially equal number of identical wheels, the wheels of the first series being mounted upon a first shaft and the wheels of the second series being mounted upon a second shaft, each wheel having a center mounting aperture and bounded by substantially flat paired radial surfaces in perpendicular disposition to the shaft, and an outer perimeter abrasive surface disposed between said radial surfaces upon a circular cylindric locus centered about said aperture, at least two segments of equal configuration being removed from the wheels at equiangular locations with respect to said center, said segments extending to the perimeter abrasive surface but not the center aperture. The mounting of the wheels upon the shafts is such that the radial surfaces of adjacent wheels are in nearly continguous abutment, and the removed segments are in straight alignment parallel to the shaft axes. The shafts are held in spaced apart parallel alignment and enabled to rotate synchronously in counter directions, whereby wheels of each series are in opposing juxtaposition, and the abrasive surfaces of alternative wheels of one series enter removed segments of opposing alternative wheels of the other series. The interaction of the two series of wheels may be further characterized in having entering and exiting nip lines, said entering nip line being defined by the series of sites where the circular paths of the opposed wheels intersect upon meeting, and the exiting nip line being defined by the series of sites where the circular paths of the opposed wheels intersect upon departing. Each wheel may have between 2 and 6 removed segments. The synchronous rotation of the shafts is preferably achieved by intermeshing gears mounted upon said shafts, but may also be achieved by interaction between the radial surfaces of the wheels of the two series.

In such manner of construction and operation, the circular abrading surfaces have leading extremities which initially contact the blade strip. In a preferred embodiment, such leading extremities are rearwardly tapered upon the abrasive perimeter so as to minimize the angle of impact upon the blade strip. Keying means are associated with each wheel to assure proper positioning upon the shaft.

In the method of the present invention, an edge of a blade strip is continuously advanced against the exiting nip line of the above-described apparatus, said blade strip being maintained in a plane that perpendicularly bisects a line drawn between the rotational axes of the two shafts.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
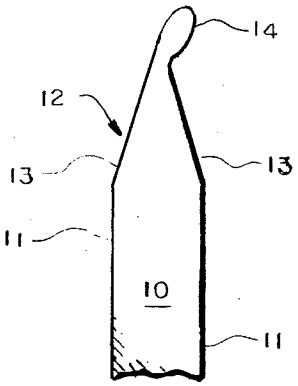
FIG. 1 is an enlarged sectional view of the cutting edge of a blade having a burr.
Figure 4:
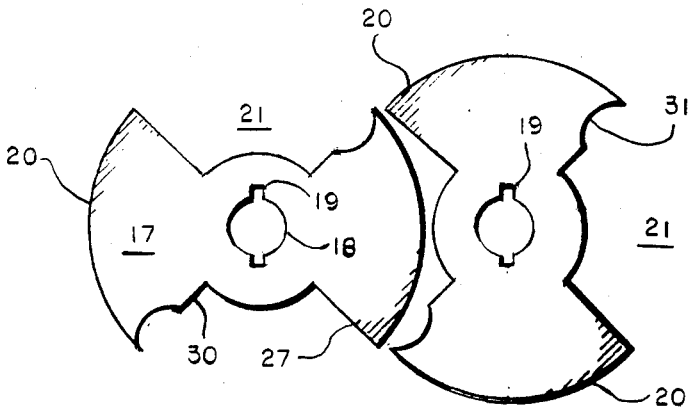
FIG. 4 is an end view showing the wheels at a different point of their rotational movement.
Figure 5:
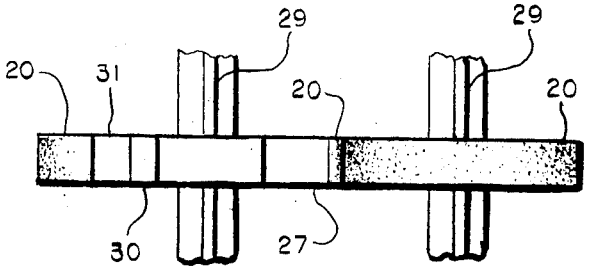
FIG. 5 is a bottom view of the two wheels shown in FIG. 4.
Figure 7:
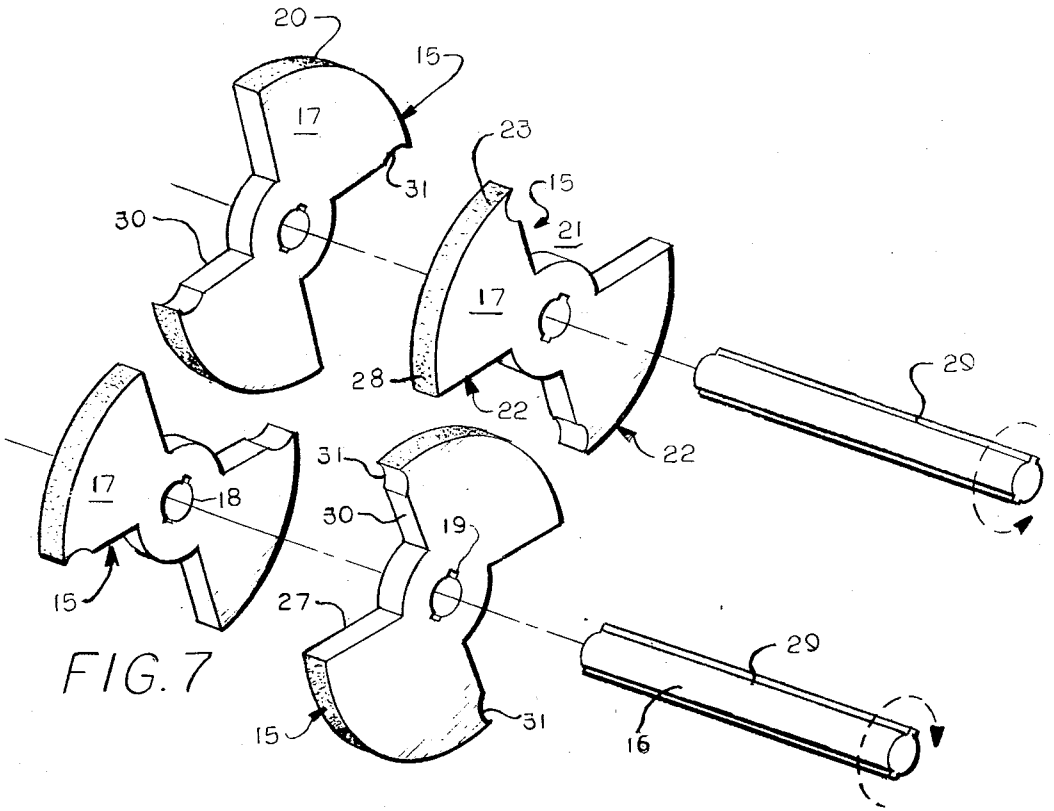
FIG. 7 is an exploded perspective view of the embodiment of FIG. 2.
Figure 6:
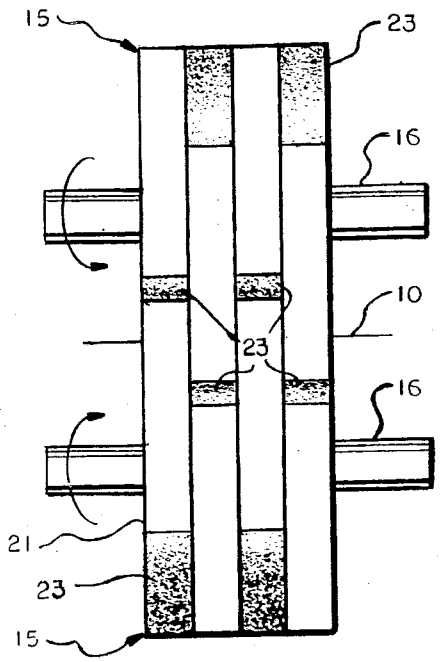
FIG. 6 is a top view of the embodiment of FIG. 2.

Referring to FIG. 1, a blade strip 10 is shown having opposed flat surfaces 11 and a doubly tapered cutting edge 12 comprised of convergent facets 13. A burr 14 is shown associated with the upper extremity of one facet. By repeated reversals of the grinding treatment which forms the facets, the burr will eventually separate from the cutting edge.

Referring to FIGS. 2–7, an embodiment of the apparatus of this invention is shown comprised of two series of abrasive wheels 15, each series having substantially the same number of identical wheels mounted upon a separate shaft 16 having keying splines 29. Each wheel is comprised of opposed parallel flat radial surfaces 17, a centered mounting aperture 18 provided with keying notches 19, an outer perimeter 20 disposed upon a circular locus with respect to the center of aperture 18, and removed segments 21 which produce discontinuities in perimeter 20 and cause the wheel to be divided into two or more lobes 22 defined by two radii of said circular locus and the included circular arc of the perimeter. The lobes are of identical configuration and are equiangularly disposed about aperture 18. A substantially flat abrading face 23 extends perpendicularly between side surfaces 17, representing both the thickness of the wheel and outer perimeter 20. In some embodiments, the abrading face may be slightly tapered so that it makes a more gradual contact with blade strip 10 in its advancing movement.

The wheels may be fabricated of metal having abrasive grit in an adhesive binder applied to said perimeter 20. Typical abrasives include cubic boron nitride, diamond, alumina, carborundum, silicon carbide, and the like. The nature of the abrasive contained by the wheels may vary along the length of series so that maximum metal removal is initially achieved, followed by a polishing or stropping effect.

The wheels are perpendicularly mounted upon their respective shafts, in a manner whereby radial surfaces 17 of contiguous wheels are in substantially contacting abutment. The mounting and the thickness of adjacent wheels are such that a clearance separation exists, permitting insertion of the lobe of a wheel of one series into the removed segment of the opposing wheel of the other series without contact of side surfaces 17. Said clearance separation, which may be a few thousandths of an inch may be achieved by spacers placed upon ;the shaft between adjacent wheels, or by diminishing the thickness of the wheels adjacent their perimeters. The mounting of the wheels upon a given shaft is such that the lobes are in straight alignment parallel to the shaft, and the lobes of any one wheel are directed toward the removed segments of adjacent wheels.

The two shafts are held in spaced apart parallel alignment by conventional mechanism (not shown) and are enabled to rotate synchronously in counter directions by enmeshing gears 24 associated with each shaft. The spacing and orientation between the two shafts is such that wheels of each series are in opposed juxtaposition, and the abrading faces 23 of the wheels of one series alternatingly enter the removed segments of the wheels of the other series. In the illustrated embodiment, each wheel has two lobes, each representing substantially a 90 degree sector of the circular perimeter of the wheel. It has been found that in order to enable the lobe to freely enter the removed segment of the opposite wheel, it is important that the lobe be about one degree less than 90 degrees,and consequently causing the removed segments to be about one degree greater than 90 degrees.

The interaction of the two series of wheels produces an entering nip line 25 and an exiting nip line 26. The abrading surfaces have leading extremities 27 which initially contact the blade strip and are provided with a slight rearward taper 28. The trailing edge 30 of the opposing blade is provided with an arcuate recess 31 adapted to receive taper 28, thereby softening the impact of the wheels.

Figure 2:
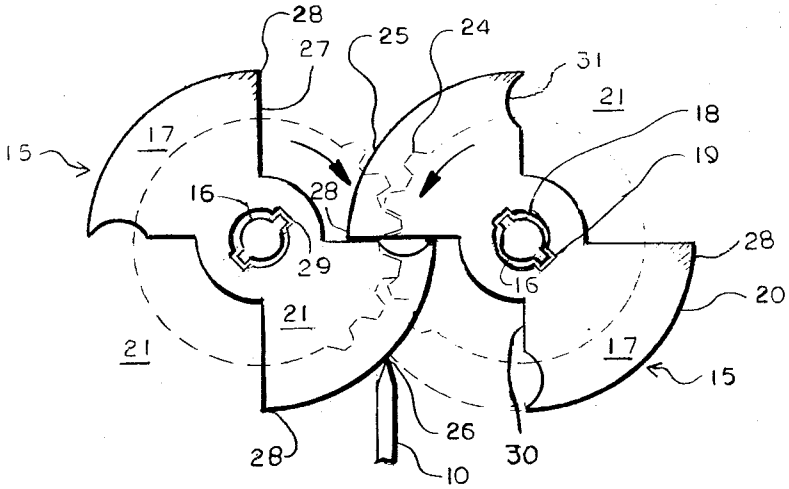
FIG. 2 is an end view of an embodiment of the apparatus of the present invention.
Figure 3:
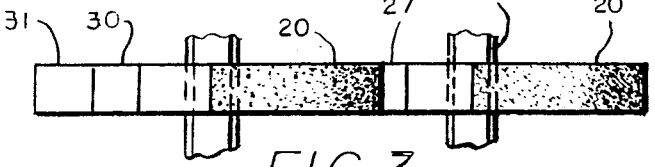
FIG. 3 is a bottom view of the two wheels shown in FIG. 2.

In the method of this invention, as best shown in FIG. 2, the blade strip is run past the wheels in a manner whereby an edge of the blade strip is held within exiting nip line 26. It is to be noted that the blade strip is centered within the plane defined by nip lines 25 and 26.

The apparatus of this invention is also useful for the sharpening of non-straight blades such as scalpel blades. In such applications the blade is not moved past the wheels but is instead merely inserted into the exiting nip. Where curved blades are to be sharpened, the wheels of the series will be sized and shaped to match the desired contour of the sought cutting edge.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An apparatus for forming sharp edges on flat metal stock comprising first and second series of abrasive wheels, each series having a substantially equal number of identical first shaft and the wheels of the second series being mounting aperture, paired substantially flat side surfaces perimeter abrasive surface disposed between said side surfaces upon a circular cylindric locus centered about said aperture, at least two segments of equal configuration being removed from the wheels at equiangular locations with respect to said center, said segments extending to the perimeter abrasive surface but not the center aperture, the mounting of the wheels upon the shafts being such that the side surfaces of adjacent wheels are nearly in abutment, said shafts being held in spaced apart parallel alignment and enabled to rotate synchronously in counter directions, whereby wheels of each series are in opposing juxtaposition, and the abrasive surfaces of alternative wheels of one series enter removed segments of opposing alternative wheels of the other series, the interaction of the two series of wheels being characterized in having entering and exiting nip lines, said entering nip line being defined by the series of sites where the circular paths of abrasive surfaces on opposed wheels intersect upon meeting, and the exiting nip line being defined by the series of sites where the circular paths of abrasive surfaces on opposed wheels intersect upon departing.

2. The apparatus of claim 1 wherein the synchronous rotation of the shafts is achieved by intermeshing gears mounted upon said shafts.

3. The apparatus of claim 1 wherein said removed segments define lobe portions uniformly spaced about the aperture of said wheel.

4. The apparatus of claim 3 wherein each lobe portion is bounded by a leading edge and a trailing edge.

5. The apparatus of claim 4 wherein the trailing edge has an arcuate recess adjacent said abrasive surface.

6. The apparatus of claim 1 wherein keying notches are disposed upon said aperture, and said shaft is provided with axially elongated splines which engage said notches.

7. The apparatus of claim 1 wherein the wheels are spaced apart sufficiently to prevent contact of the side surfaces of adjacent wheels.

* * * * *